US006279740B1

(12) United States Patent
Dorman

(10) Patent No.: US 6,279,740 B1
(45) Date of Patent: Aug. 28, 2001

(54) DUAL PURPOSE GOLF BAG SYSTEM

(76) Inventor: Harold R. Dorman, 3215 Lori La., New Port Richey, FL (US) 34655

( * ) Notice: Subject to any disclaimer, the term of this patent is extended or adjusted under 35 U.S.C. 154(b) by 0 days.

(21) Appl. No.: 09/679,758

(22) Filed: Oct. 5, 2000

(51) Int. Cl.[7] ..... A63B 55/00; A63B 55/08

(52) U.S. Cl. ..... 206/315.3; 206/315.4; 206/315.5

(58) Field of Search ..... 206/315.3–315.6, 206/315.8

(56) References Cited

U.S. PATENT DOCUMENTS

| | | | | |
|---|---|---|---|---|
| 1,419,425 | * | 6/1922 | Terr | 206/315.8 |
| 3,901,299 | * | 8/1975 | Picco | 206/315.4 |
| 3,953,045 | * | 4/1976 | Feret, Jr. | 206/315.6 X |
| 4,249,586 | * | 2/1981 | Setani | 206/315.4 |
| 4,509,643 | * | 4/1985 | Rhee | 206/315.3 X |
| 4,709,814 | * | 12/1987 | Antonious | 206/315.3 |
| 5,566,825 | * | 10/1996 | Proce | 206/315.5 |
| 5,899,328 | * | 5/1999 | Dulyea, Sr. | 206/315.3 |
| 5,918,737 | * | 7/1999 | Kwon | 206/315.5 X |
| 5,988,379 | * | 11/1999 | Yearous | 206/315.5 X |

* cited by examiner

*Primary Examiner*—Sue A. Weaver

(57) ABSTRACT

The dual purpose golf bag system allows for the conversion of two normally configured golf bags into one travel and/or storage container using primarily the inner supports of the two individual bags as the structural component of the travel/storage container. The system comprises a smaller bag with a removable cover and a slightly larger bag with a removable cover. When used in a travel/storage mode, the small bag nests inside the larger bag to form a rigid container to hold the clubs and associated accessories. The small and large golf bags have rigid interior supports. The supports have circular bottoms and cylindrical sidewalls and open tops. The small removable cover and the large removable cover are each formed of a flexible fabric with a base, a cylindrical peripheral wall and an open top. A fastener extends along the length of the cylindrical peripheral wall of each of the covers allowing for removal of the covers from the interior supports so that the interior supports can be nested to form a rigid travel/storage container. For convenience of travel and for protection of the interior components of the bags, a retaining cover, formed of a flexible fabric, has a bottom and a top both formed in a circular configuration and a cylindrical peripheral wall attached to the peripheries of the bottom and top. A zipper extends along the length of the peripheral cylindrical wall to allow mounting and dismounting the retaining cover with respect to the interior supports.

8 Claims, 4 Drawing Sheets

DUAL PURPOSE GOLF BAG SYSTEM

BACKGROUND OF THE INVENTION

1. Field of the Invention

The present invention relates to a golf bag system and more particularly pertains to simplifying the storage and transportation of two golf bags with associated sets of golf clubs in one convertible container utilizing components of the two bags virtually the size of one bag.

At the present time when two or more golfers want to travel together each carries a bag with their respective clubs, balls, tees, gloves and other personal effects. This arrangement normally occupied significant space in the vehicle transporting the golfers and their equipment. The dual purpose golf bag system, as described in the present invention, allows two golfers to combine their golf bags, clubs and other accessories into one rigid container approximately the size of one golf bag for transport. Upon reaching their destination the golfers would convert the travel bag (rigid container) back to two individual, full-size bags utilizing specially designed covers which attach to rigid inner supports.

2. Description of the Prior Art

The use of golf bags of known designs and configurations is known in the prior art. More specifically, golf bags of known designs and configurations previously devised and utilized for the purpose of facilitating the handling of golf clubs and golf bags through known methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 5,816,398 to Wang issued Oct. 6, 1998 discloses a partitioned insert for golf bags. U.S. Pat. No. 5,402,293 to Snyder issued Apr. 4, 1995 relates to a device for the holding and transport of golf clubs. U.S. Pat. No. 4,657,135 to Kjose issued Apr. 14, 1987 discloses a combined golf bag and equipment carrier. Lastly, U.S. Pat. No. 5,918,737 to Kwon issued Jul. 6, 1999 relates to a dual golf bag.

While these devices fulfill their respective, particular objectives and requirements, the aforementioned patents do not describe a golf bag system that allows simplifying the storage and transportation of two golf bags with associated sets of golf clubs in one container utilizing the inner supports of the two bags as the primary structural component of the single container.

In this respect, the dual purpose golf bag system according to the present invention substantially departs from the conventional concepts and designs of the prior art, and in doing so provides an apparatus primarily developed for the purpose of simplifying the storage and transportation of two golf bags with associated sets of golf clubs into one self-contained travel/storage bag.

Therefore, it can be appreciated that there exists a continuing need for a new and improved golf bag system which can be used for simplifying the storage and transportation of two golf bags with associated sets of golf clubs. In this regard, the present invention substantially fulfills this need.

SUMMARY OF THE INVENTION

In view of the foregoing disadvantages inherent in the known types of golf bags of known designs and configurations now present in the prior art, the present invention provides an improved golf bag system which allows for the breakdown of two golf bags into separate components, combines the clubs and covers into one container for the purpose of saving space and potentially reducing freight charges and then restoring the bag configuration to its original form as needed to play golf. As such, the general purpose of the present invention, which will be described subsequently in greater detail, is to provide a new and improved dual purpose golf bag system and method which has all the advantages of the prior art and none of the disadvantages.

To attain this, the present invention essentially comprises a two golf bags and a retaining cover. The small golf bag has a rigid small interior support. The interior support has a circular bottom and a cylindrical sidewall formed with a circular cross sectional configuration. The interior support has an open top. The small interior support has an axial length of about 30 inches, an interior diameter of about 9.25 inches, and an exterior diameter of about 9.875 inches. A small removable cover is provided for the small golf bag. The small removable cover is formed of a flexible fabric. The small golf bag has a base formed as a diametric strap with an adjustable buckle. The cover also has a cylindrical peripheral wall with a circular cross sectional configuration. The cover has an open top divided into segments for club separation. The cylindrical peripheral wall has an axial length of about 30 inches and a diameter of about 9.875 inches. The small removable cover also has a lower collar of moderate rigidity around the lower extent of the cylindrical peripheral wall. The small removable cover also has an upper collar of moderate rigidity above the upper extent of the cylindrical peripheral wall and the small interior support. A pair of semi-rigid club dividers are provided across the upper collar. A zipper is provided. The zipper extends along the length of the cylindrical peripheral wall from beneath the upper collar to beneath the lower collar to allow mounting and dismounting the small removable cover with respect to the small interior support. A large golf bag is also provided. The large golf bag has a rigid large interior support. The large interior support has a circular bottom. The large interior support also has a cylindrical sidewall formed with a circular cross sectional configuration. The large interior support also has an open top. The large interior support has an axial length of about 30.5 inches, an interior diameter of about 9.875 inches, and an exterior diameter of about 10.5 inches. A large removable cover is provided for the large golf bag. The large removable cover is formed of a flexible fabric. The large golf bag has a base formed as a diametric strap with an adjustable buckle. The cover also has a cylindrical peripheral wall with a circular cross sectional configuration. The cover has an open top divided into segments for club separation. The cylindrical peripheral wall has an axial length of about 30.5 inches and a diameter of about 10.5 inches. The large removable cover also has a lower collar of moderate rigidity around the lower extent of the cylindrical peripheral wall. The large golf bag also has an upper collar of moderate rigidity above the upper extent of the cylindrical peripheral wall and the large interior support. A pair of semi-rigid club dividers are provided across the upper collar of the large golf bag. A zipper is provided. The zipper extends along the length of the cylindrical peripheral wall from beneath the upper collar to beneath the lower collar to allow mounting and dismounting the large removable cover with respect to the large interior support. Next provided are multiple hand straps and shoulder straps. Also provided are a plurality of pockets formed on the exterior surface of each of the removable covers. At least one of the pockets is formed in a rectilinear configuration with a zipper across the top and down the sides and with a plurality of fabric dividers vertically aligned within the pocket to divide the pocket into a plurality of laterally spaced sections. A retaining cover is next provided. The retaining cover is preferably formed of a flexible fabric. The retaining cover has a bottom formed in a circular configuration with a periphery. The retaining cover also has a top formed in a circular configuration. The retaining cover also has a cylindrical peripheral wall with a circular cross sectional configuration. The retaining cover also has a bottom edge attached to the periphery of the bottom. The retaining cover also has a top edge attached to the periphery of the top. The cylindrical peripheral wall has an axial length of about 45 inches and a diameter of about 11.5 inches. The retaining cover is also provided with a zipper. The zipper extends along the length of the cylindrical peripheral wall from above the bottom to the top and diametrically across the top. When the system is configured for storage and/or travel, the two sets of golf clubs and the large and small covers plus golf balls, tees and sundry personal effects are placed in one of the interior supports, the other interior support is then inverted with the small interior support nested within the large interior support with the circular bottoms spaced to form an enclosure. The zipper allows mounting and dismounting the retaining cover with respect to the now combined small and large interior supports. Lastly, a C-shaped ring is provided. The C-shaped ring is attached to the periphery of the bottom of the retaining cover. Two wheels are provided. The wheels are on a common axis and are attached to the ends of the ring to facilitate movement of the entire package. Hand straps are also provided. The hand straps are attached to the outside of the retaining cover and to the top for further facilitating transportation and handling.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved golf bag system which has all of the advantages of the prior art golf bags of known designs and configurations and none of the disadvantages.

It is another object of the present invention to provide a new and improved golf bag system which may be easily and efficiently manufactured and marketed.

It is a further object of the present invention to provide a new and improved golf bag system which is of durable and reliable constructions.

An even further object of the present invention is to provide a new and improved golf bag system which is susceptible of a low cost of manufacture with regard to both materials and labor, and which accordingly is then susceptible of low prices of sale to the consuming public, thereby making such golf bag system economically available to the buying public.

Even still another object of the present invention is to provide a golf bag system for simplifying the storage and transportation of two golf bags with associated sets of golf clubs into a rigid container approximately the size of one golf bag.

Lastly, it is an object of the present invention to provide a new and improved dual purpose golf bag system comprised of a small golf bag with a cover, a large golf bag with a cover, and a retaining cover which can be converted from two individual bags and used for normal play, to a single container system for transportation, storage, and vice versa. The small golf bag has a small rigid interior support. The large golf bag has a large rigid interior support. The supports have circular bottoms and cylindrical sidewalls and open tops. The small removable cover and the large removable cover are each formed of a flexible fabric with a base, a shoulder strap, a cylindrical peripheral wall and a divided open top. A fastener (zipper) extends along the length of each of the cylindrical peripheral walls. A retaining cover, formed of a flexible fabric, has a bottom and a top both formed in a circular configuration and a cylindrical peripheral wall attached to the peripheries of the bottom and top. A zipper extends along the length of the peripheral cylindrical wall to allow mounting and dismounting the retaining cover with respect to the large and small nested interior supports.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
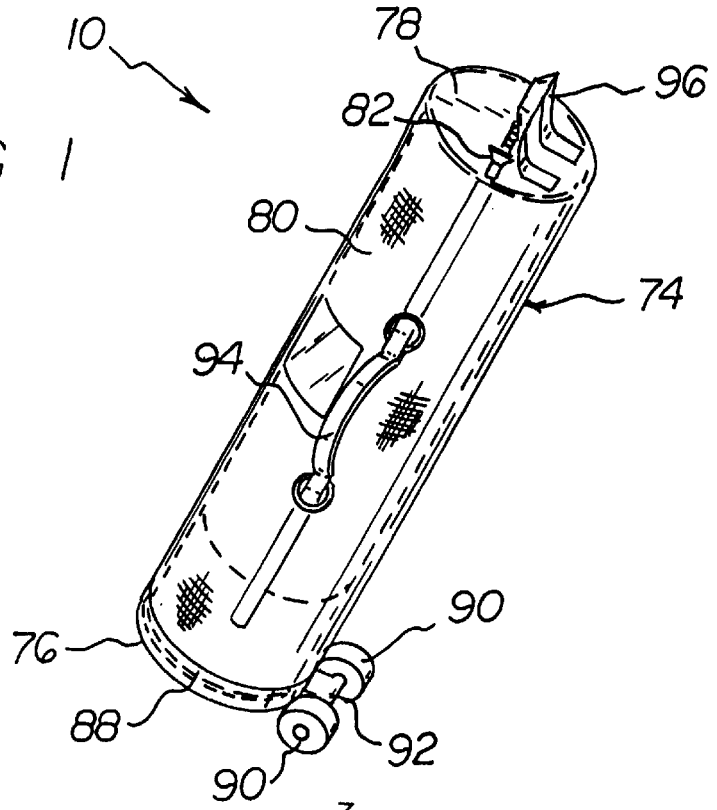
FIG. 1 is a perspective illustration of a dual purpose golf bag system constructed in accordance with the principles of the present invention shown in the transportation and storage mode.
Figure 2:
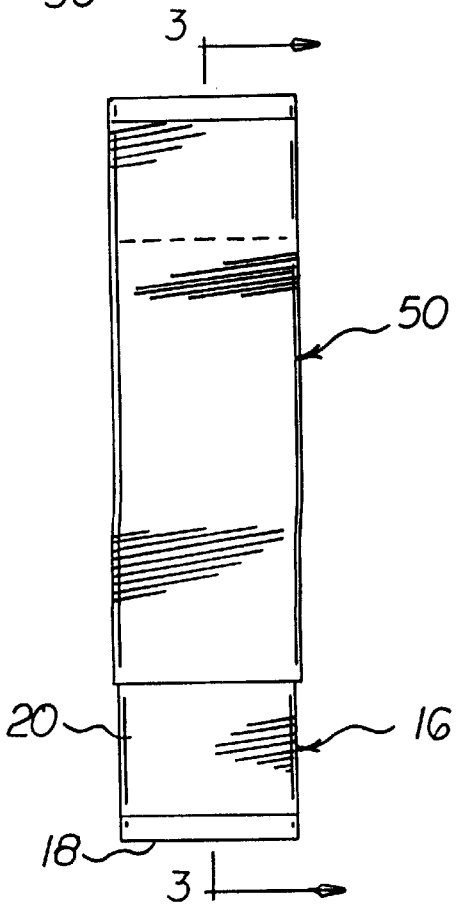
FIG. 2 is a front elevational view of the system shown in FIG. 1 but with the retaining cover removed.
Figures 3, 4:
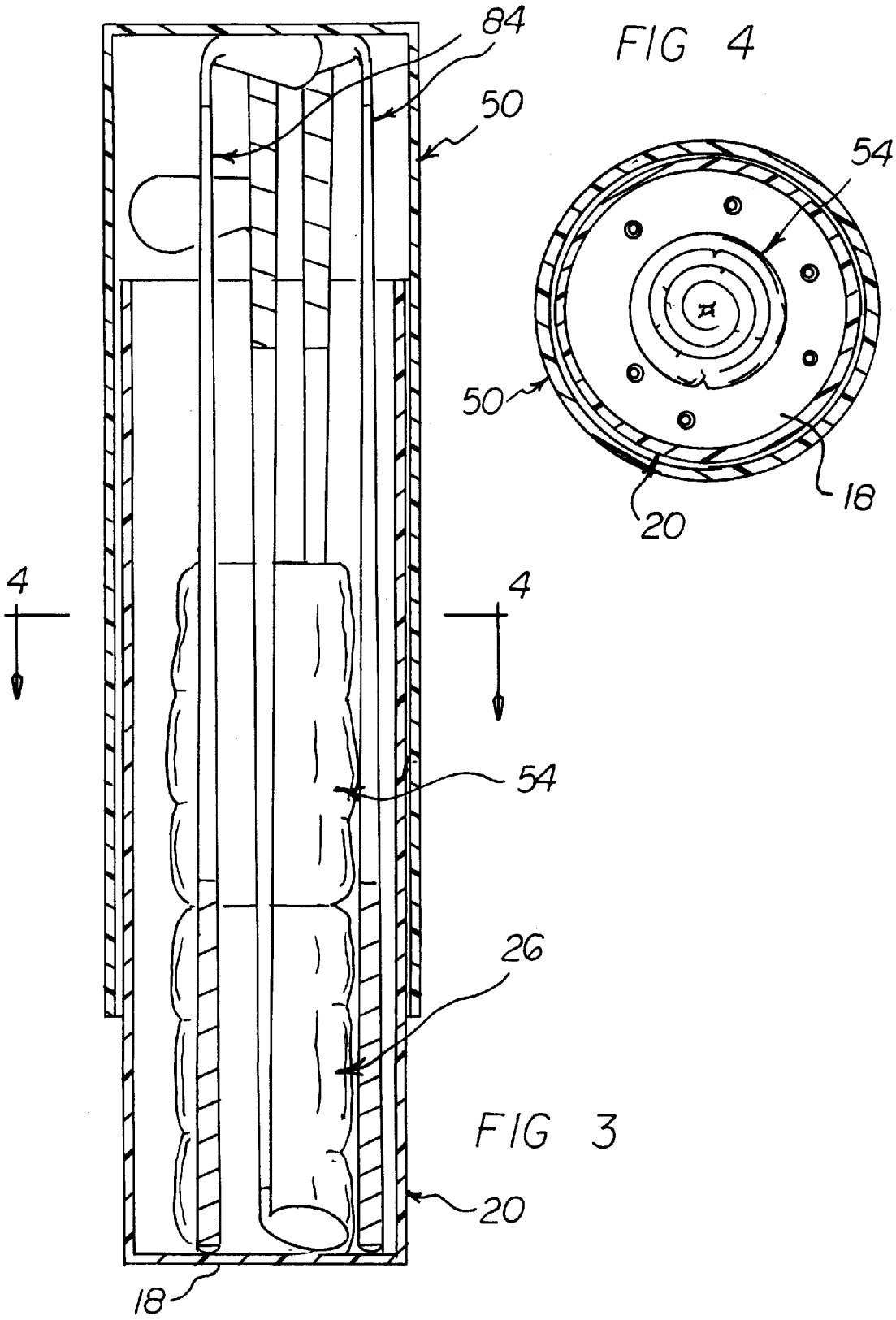
FIG. 3 is a cross sectional view taken along line 3—3 of FIG. 2.
FIG. 4 is a cross sectional view taken along line 4—4 of FIG. 3.
Figure 5:
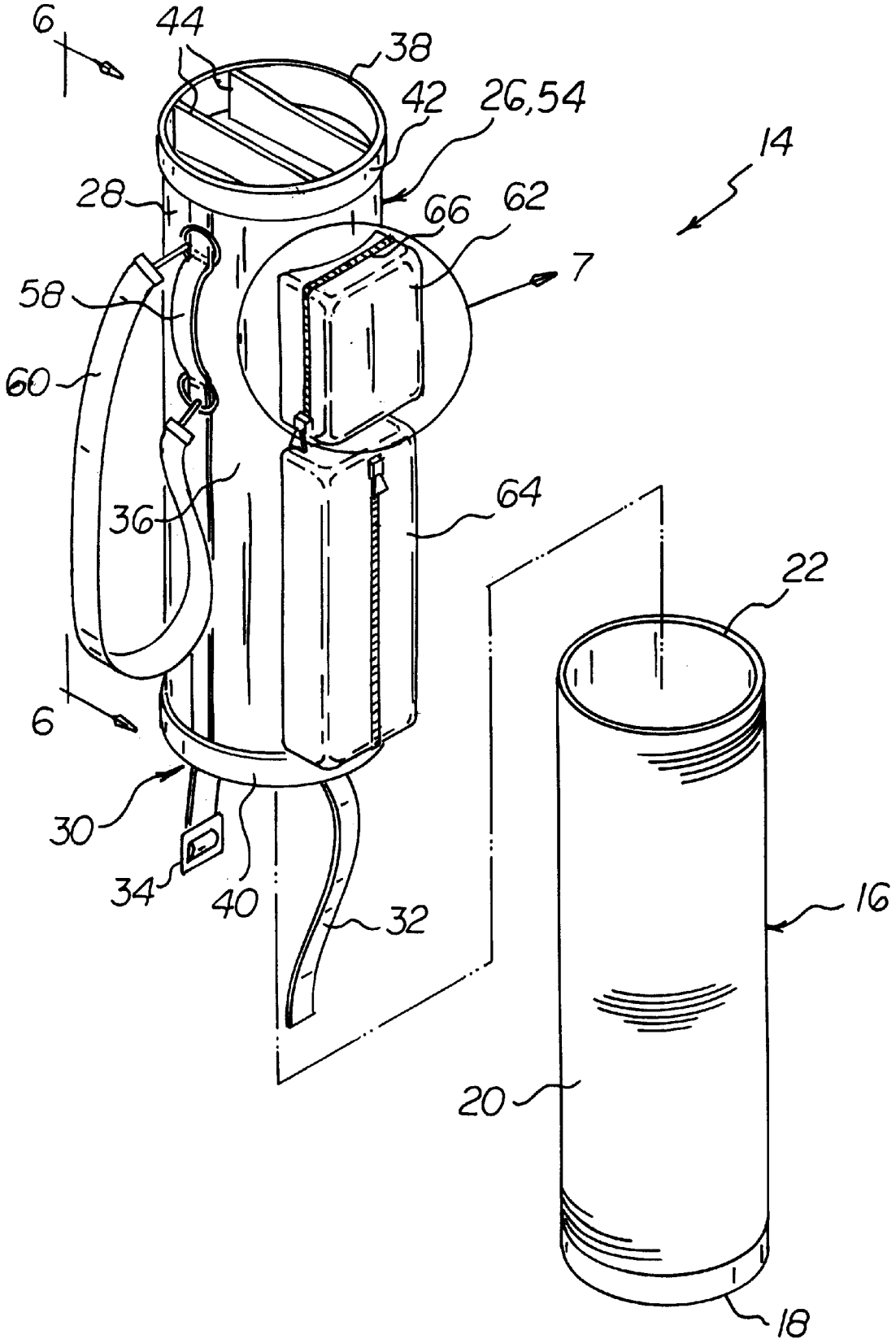
FIG. 5 is an exploded perspective illustration of one of the golf bags of the prior figures, both bags being essentially the same except for size.
Figure 6:
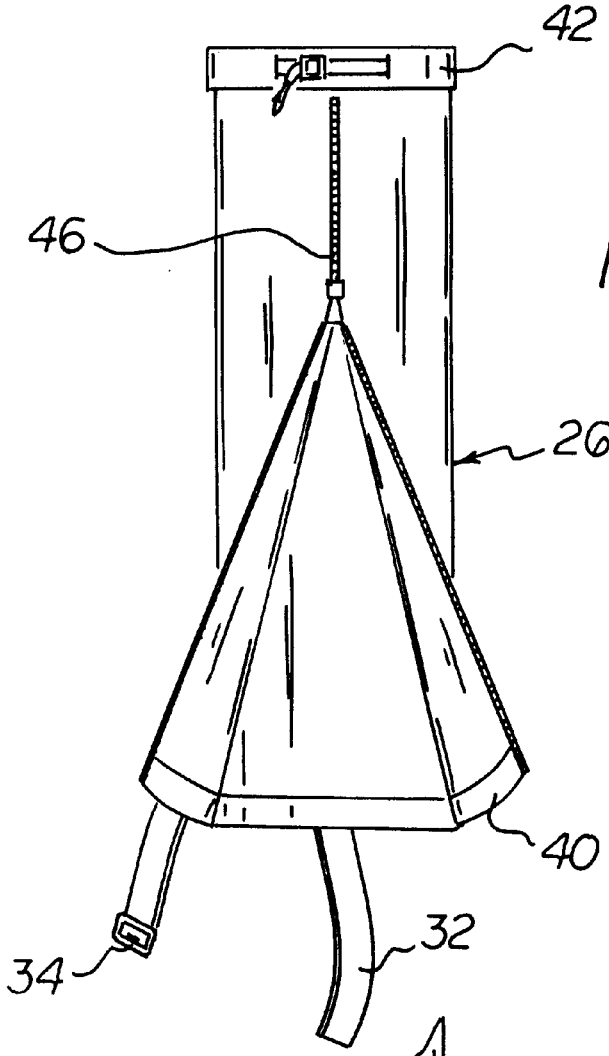
FIG. 6 is a side elevational view taken along line 6—6 of FIG. 5.
Figure 7:
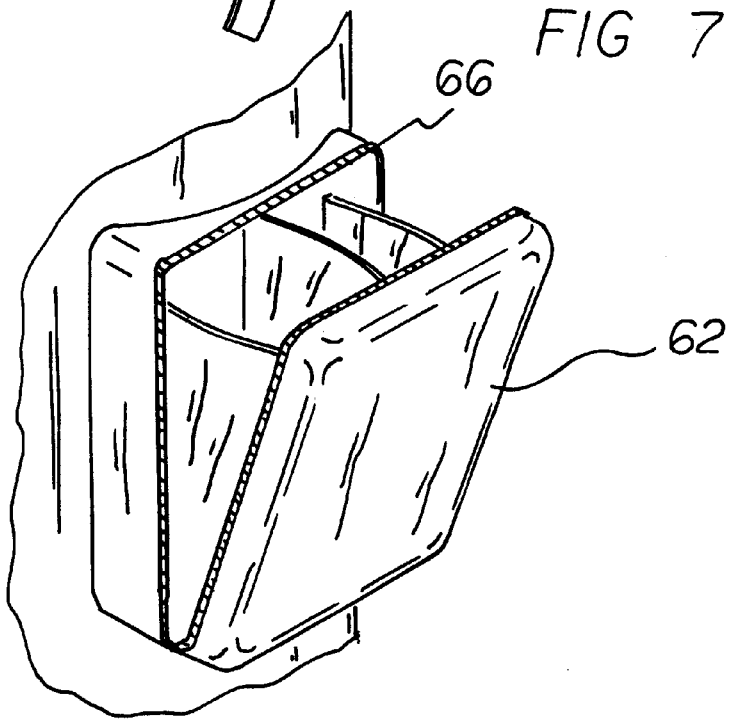
FIG. 7 is a perspective illustration of a top pocket taken at circle 7 of FIG. 6 but with the pocket open.

With reference now to the drawings, and in particular to FIG. 1 thereof, the preferred embodiment of the new and improved golf bag system embodying the principles and concepts of the present invention and generally designated by the reference numeral 10 will be described.

The present invention, the convertible golf bag system 10 is comprised of a plurality of components. Such components in their broadest context include a small golf bag with a removable cover, a large golf bag with a removable cover, and a retaining cover. Such components are individually configured and correlated with respect to each other so as to attain the desired objective.

First provided is a small golf bag 14. The small golf bag has a rigid small interior support 16. The interior support has a circular bottom 18 and a cylindrical sidewall 20 formed with a circular cross sectional configuration. The interior support has an open top 22. The small interior support has an axial length of about 30 inches, an interior diameter of about 9.25 inches, and an exterior diameter of about 9.875 inches.

A small removable removable cover 26 is provided for the small golf bag. The small removable cover is formed of a flexible fabric 28. The small golf bag has a base 30 formed as a diametric strap 32 with an adjustable buckle 34. The cover also has a cylindrical peripheral wall 36 with a circular cross sectional configuration. The cover has an open divided top 38. The cylindrical peripheral wall has an axial length of about 30 inches and a diameter of about 9.875 inches. The small removable cover also has a lower collar 40 of moderate rigidity around the lower extent of the cylindrical peripheral wall. The small removable cover also has an upper collar 42 of moderate rigidity above the upper extent of the cylindrical peripheral wall and the small interior support. A pair of semi-rigid club dividers 44 are provided across the upper collar. A zipper 46 is provided. The zipper extends along the length of the cylindrical peripheral wall from beneath the upper collar to beneath the lower collar to allow mounting and dismounting the small removable cover with respect to the small interior support.

A large golf bag is also provided. The large golf bag has a rigid large interior support 50. The large interior support has a circular bottom. The large interior support also has a cylindrical sidewall formed with a circular cross sectional configuration. The large interior support also has an open top. The large interior support has an axial length of about 30.5 inches, an interior diameter of about 9.875 inches, and an exterior diameter of about 10.5 inches. The large interior support is slid over the smaller interior support in a nesting relationship to form a container with the bottoms at the remote ends and with the open tops at an intermediate extent A removable large cover 54 is provided for the large golf bag. The removable large cover is formed of a flexible fabric. The large cover has a base formed as a diametric strap with an adjustable buckle. The cover also has a cylindrical peripheral wall with a circular cross sectional configuration. The cover has an open top. The cylindrical peripheral wall has an axial length of about 30.5 inches and a diameter of about 10.5 inches. The large cover also has a lower collar of moderate rigidity around the lower extent of the cylindrical peripheral wall. The large cover also has an upper collar of moderate rigidity above the upper extent of the cylindrical peripheral wall and the large interior support. A pair of semi-rigid club dividers are provided across the upper collar of the large removable cover. A zipper is provided. The zipper extends along the length of the cylindrical peripheral wall from beneath the upper collar to beneath the lower collar to allow mounting and dismounting the large removable cover with respect to the large interior support.

Next provided are a hand strap 58 and a shoulder strap 60. Also provided are a plurality of pockets 62, 64 formed on the exterior surface of each of the removable covers. At least one of the pockets 62 is formed in a rectilinear configuration with a zipper 66 across the top and down the sides and with a plurality of fabric dividers vertically aligned within the pocket to divide the pocket into a plurality of laterally spaced sections.

A retaining cover 74 is next provided. The retaining cover is formed of a flexible fabric. The retaining cover has a bottom 76 formed in a circular configuration with a periphery. The retaining cover also has a top 78 formed in a circular configuration. The retaining cover also has a cylindrical peripheral wall 80 with a circular cross sectional configuration. The retaining cover also has a bottom edge attached to the periphery of the bottom. The retaining cover also has a top edge attached to the periphery of the top. The cylindrical peripheral wall has an axial length of about 45 inches and a diameter of about 11.5 inches. The retaining cover is also provided with a zipper 82. The zipper extends along the length of the cylindrical peripheral wall from above the bottom to the top and diametrically across the top. When the system is configured for storage and/or travel, two sets of golf clubs 84 and the large and small covers plus golf balls, tees and other sundry personal effects are placed in one of the interior supports, the other interior support is then inverted with the small interior support nested within the large interior support with the circular bottoms spaced to form an enclosure or container. The zipper allows mounting and dismounting the retaining cover with respect to the interior supports. The retaining cover thus functions as a retainer for the container formed of the two nested interior supports.

Lastly, a C-shaped ring 88 is provided. The C-shaped ring is attached to the periphery of the bottom of the retaining cover. Two wheels 90 are provided. The wheels are on a common axis 92 and are attached to the ends of the ring to facilitate transportation. Hand straps 94, 96 are also provided. The hand straps are attached to the outside of the retaining cover and to the top for further facilitating transportation and handling.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A convertible dual purpose golf bag system for simplifying the storage and transportation of two golf bags with associated sets of golf clubs in one container approximately the size of one bag comprising, in combination:

a small golf bag having a rigid small interior support with a circular bottom and a cylindrical side wall formed with a circular cross sectional configuration and an open top, the small interior support having an axial length of about 30 inches and an interior diameter of about 9.25 inches and an exterior diameter of about 9.875 inches;

the small golf bag also having a small removable cover formed of a flexible fabric with a base formed as a diametric strap with an adjustable buckle and also having a cylindrical peripheral wall with a circular cross sectional configuration and a divided open top, the cylindrical peripheral wall having an axial length of about 30 inches and a diameter of about 9.875 inches, the small removable cover also having a lower collar of moderate rigidity around the lower extent of the cylindrical peripheral wall and an upper collar of moderate rigidity above the upper extent of the cylindrical peripheral wall and the small interior support and with a pair of semi-rigid club dividers there across, the cylindrical peripheral wall having a zipper extending along the length thereof from beneath the upper collar to beneath the lower collar to allow mounting and dismounting the removable small cover with respect to the small interior support;

a large golf bag having a rigid large interior support with a circular bottom and a cylindrical side wall formed with a circular cross sectional configuration and an open top, the large interior support having an axial length of about 30.5 inches and an interior diameter of about 9.875 inches and an exterior diameter of about 10.5 inches;

the large golf bag also having a removable large cover formed of a flexible fabric with a base formed as a diametric strap with an adjustable buckle and also having a cylindrical peripheral wall with a circular cross sectional configuration and a divided open top, the cylindrical peripheral wall having an axial length of about 30.5 inches and a diameter of about 10.5 inches, the large removable cover also having a lower collar of moderate rigidity around the lower extent of the cylindrical peripheral wall and an upper collar of moderate rigidity above the upper extent of the cylindrical peripheral wall and the large interior support and with a pair of semi-rigid club dividers there across, the cylindrical peripheral wall having a zipper extending along the length thereof from beneath the upper collar to beneath the lower collar to allow mounting and dismounting the removable large cover with respect to the large interior cylindrical support;

a hand strap and a shoulder strap and a plurality of pockets formed on the exterior surface of each of the covers, at least one of the pockets being in a rectilinear configuration with a zipper across the top and down the sides and with a plurality of fabric dividers vertically aligned within the pocket to divide the pocket into a plurality of laterally spaced sections;

a retaining cover formed of a flexible fabric with a bottom formed in a circular configuration with a periphery and a top formed in a circular configuration with a periphery also having a cylindrical peripheral wall with a circular cross sectional configuration and a bottom edge attached to the periphery of the bottom and a top edge attached to the periphery of the top, the cylindrical peripheral wall having an axial length of about 45 inches and a diameter of about 11.5 inches, the cylindrical peripheral wall having a zipper extending along the length thereof from above the bottom to the top and diametrically across the top to allow mounting and dismounting the retaining cover with respect to the large interior support with the small interior support nested there within and with circular bottoms spaced to form an enclosure for the receipt of two sets of golf clubs and the large and small covers; and a C-shaped ring attached to the periphery of the bottom of the retaining cover with two wheels on a common axis attached to the ends of the ring to facilitate transportation and with hand straps attached to the outside of the retaining cover and to the top for further facilitating transportation and handling.

2. A convertible dual purpose golf bag system comprising:

a small golf bag having a rigid small interior support with a circular bottom and a cylindrical side wall and an open top;

the small golf bag also having a small cover formed of a flexible fabric with a base and also having a cylindrical peripheral wall and an open top, the cylindrical peripheral wall having a fastener extending along the length thereof;

a large golf bag having a rigid large interior support with a circular bottom and a cylindrical side wall and an open top;

the large golf bag also having a large cover formed of a flexible fabric with a base and also having a cylindrical peripheral wall and an open top, the cylindrical peripheral wall having a fastener extending along the length thereof;

a retaining cover with a bottom formed in a circular configuration and a top formed in a circular configuration and also having a cylindrical peripheral attached to the periphery of the bottom and to the periphery of the top, the cylindrical peripheral wall having a fastener extending along the length thereof allow mounting and dismounting the retaining cover with respect to the nested small and large interior supports.

3. The system as set forth in claim 2 and further including:

a hand strap and a shoulder strap formed on the exterior surface of each of the covers.

4. The system as set forth in claim 2 and further including:

a pocket formed on the exterior surface of each of the covers in a rectilinear configuration with a fastener across the top and down the sides and with a plurality of fabric dividers vertically aligned within the pocket to divide the pocket into a plurality of laterally spaced sections.

5. The system as set forth in claim 2 and further including:

a C-shaped ring attached to the periphery of the bottom of the retaining cover with two wheels on a common axis attached to the ends of the ring to facilitate transportation and with hand straps attached to the outside of the retaining cover and to the top for further facilitating transportation and handling.

6. The system as set forth in claim 2 and further including:

a pocket formed on the exterior surface of one of the covers in a rectilinear configuration with a fastener across the top and down the sides and with a plurality of fabric dividers vertically aligned within the pocket to divide the pocket into a plurality of laterally spaced sections.

7. A golf bag system comprising:

a golf bag having a rigid interior support with a bottom and a cylindrical side wall and an open top; and a removable cover formed of a flexible fabric with a base and a cylindrical peripheral wall and a divided open top, the cylindrical peripheral wall having a fastener extending along the length thereof.

8. The system as set forth in claim 7 and further including:

a hand strap and a shoulder strap formed on the exterior surface of the cover.

* * * * *